US008407840B2

(12) United States Patent
Fleischer et al.

(10) Patent No.: US 8,407,840 B2
(45) Date of Patent: Apr. 2, 2013

(54) SELF RELEASING CABLE SYSTEM

(75) Inventors: Corey Fleischer, Baltimore, MD (US); Bob B. Williams, Joppa, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 715 days.

(21) Appl. No.: 12/608,200

(22) Filed: Oct. 29, 2009

(65) Prior Publication Data

US 2011/0052326 A1 Mar. 3, 2011

Related U.S. Application Data

(60) Provisional application No. 61/238,999, filed on Sep. 1, 2009.

(51) Int. Cl.
*E01D 15/22* (2006.01)

(52) U.S. Cl. ..... 14/34; 114/362; 292/95; 292/121; 14/71.3

(58) Field of Classification Search ..... 14/69.5, 14/31, 34, 71.1, 71.3; 292/80, 95, 121, 194, 292/219

See application file for complete search history.

(56) References Cited

U.S. PATENT DOCUMENTS

| | | | | |
|---|---|---|---|---|
| 141,233 | A | 7/1873 | Okerlund | |
| 259,685 | A * | 6/1882 | Haven et al. | 14/69.5 |
| 531,126 | A | 12/1894 | Lott | |
| 937,097 | A | 10/1909 | Schroder | |
| 963,087 | A | 7/1910 | Sproul | |
| 1,023,148 | A | 4/1912 | Hartman | |
| 1,171,580 | A | 2/1916 | Atterbury | |
| 1,314,484 | A | 8/1919 | Baash | |
| 1,442,188 | A | 1/1923 | Stokes | |
| 1,498,250 | A | 6/1924 | Trailor et al. | |
| 1,500,904 | A | 7/1924 | Shipley | |
| 1,569,918 | A | 1/1926 | Flynn | |
| 1,651,322 | A | 11/1927 | Carter | |
| 1,851,116 | A | 3/1932 | Spiro | |
| 1,910,937 | A | 5/1933 | Thane | |
| 2,016,683 | A | 10/1935 | Moore | |
| 2,138,057 | A | 11/1938 | Armentrout et al. | |
| 2,266,873 | A | 12/1941 | Lang | |
| 2,296,397 | A | 9/1942 | Muhlbach | |
| 2,634,156 | A | 4/1953 | Crimmel | |
| 2,712,405 | A | 7/1955 | Rockcastle | |

(Continued)

FOREIGN PATENT DOCUMENTS

FR 2465640 A1 3/1981

OTHER PUBLICATIONS

International Search Report for International Patent Application No. PCT/US2010/07440, dated Dec. 3, 2010.

*Primary Examiner* — Raymond W Addie
(74) *Attorney, Agent, or Firm* — Graybeal Jackson LLP; Kevin D. Jablonski

(57) ABSTRACT

An embodiment of a self-releasing cable lift system may include a latch coupled to a winch and operable to lift an object, such as a gangway, into a secured position before self-releasing after the object is locked into place. Such a latch may be biased to an open position when setting free, but biased to a closed position when acted upon by an outside surface. Thus, the latch includes a first biasing surface that is operable to bias the latch to the closed position when the latch is moved into contact with a latch receptacle in a first direction. Further, the latch includes a second biasing surface that is operable to bias the latch to a closed position when it is moved into contact with a sleeve, in a second direction. In this manner, the latch may engage a gangway, when lowered, but then self-release when the gangway has been raised.

15 Claims, 4 Drawing Sheets

U.S. PATENT DOCUMENTS

| | | | | |
|---|---|---|---|---|
| 2,712,469 | A | 7/1955 | Burnor et al. | |
| 2,832,633 | A | 4/1958 | Compson | |
| 2,951,725 | A | 9/1960 | St. Jean | |
| 3,075,800 | A | 1/1963 | Rowekamp | |
| 3,109,677 | A | 11/1963 | Hoover, Sr. | |
| 3,135,340 | A | 6/1964 | Robinsky | |
| 3,164,406 | A | 1/1965 | Barry | |
| 3,199,161 | A | 8/1965 | Hamilton | |
| 3,214,948 | A | 11/1965 | Modrey | |
| 3,251,623 | A | 5/1966 | Fredholm | |
| 3,310,337 | A | 3/1967 | Riemenschneider | |
| 3,531,066 | A | 9/1970 | Baekken | |
| 3,567,269 | A | 3/1971 | Jensen | |
| 3,735,440 | A | 5/1973 | Hetmanski | |
| 4,004,835 | A | 1/1977 | Taylor | |
| 4,590,634 | A * | 5/1986 | Williams | 14/71.1 |
| 6,257,636 | B1 | 7/2001 | Hovis et al. | |
| 6,347,424 | B1 * | 2/2002 | Vatne | 14/69.5 |
| 6,409,428 | B1 * | 6/2002 | Moog | 405/169 |
| 6,692,216 | B2 | 2/2004 | Reznar et al. | |
| 6,955,134 | B2 * | 10/2005 | Prins | 114/230.17 |
| 7,618,223 | B1 * | 11/2009 | Begley | 414/139.4 |
| 8,127,388 | B2 * | 3/2012 | Watchorn et al. | 14/2.6 |
| 2005/0207837 | A1 | 9/2005 | Kosh et al. | |
| 2008/0289126 | A1 * | 11/2008 | Stapel | 14/71.1 |
| 2009/0169249 | A1 | 7/2009 | Watanabe | |
| 2009/0199354 | A1 | 8/2009 | Birmingham | |
| 2011/0047723 | A1 | 3/2011 | Fleischer et al. | |
| 2012/0031320 | A1 * | 2/2012 | Bauduin et al. | 114/264 |

* cited by examiner

SELF RELEASING CABLE SYSTEM

PRIORITY CLAIM

The present application claims the benefit of U.S. Provisional Patent Application Ser. No. 61/238,999, filed Sep. 1, 2009, which application is incorporated herein by reference in its entirety.

BACKGROUND

Transporting crew members of ships from the ship to a location off-ship, such as to a nearby oil platform, can be challenging in times of inclement weather. Wave heights of 30-40 feet may be common in the high seas and wind speeds of 30-40 knots can be common, thus making getting on and off ships difficult because the ship may be listing about in relation to any nearby structure.

In the past, helicopters and/or cranes were used to lift and carry baskets that held crew. The crane or helicopter would engage and lift the basket and then carry the basket, with crew in tow, to the destination, e.g., from the ship to the platform. This method, however, is time-consuming and requires many levels of coordination both on and off the ship for arranging for crew members to get on or off the ship.

More recently, gangway techniques have been used wherein a free end of a ramp attached to the deck of a platform may be maneuvered to engage the nearby ship. Such techniques are only suitable for use in relatively low sea states since inclement weather may produce substantial movement of the ramp. Of course, substantial movement of the ramp poses safety risks to any crew members that may be using the ramp at the time. Further, cables that may be attached to the ramp are typically secured via manual attachment. Thus, if the ship needs to get away from the platform fast in an emergency, the securing cables need to be released by a crew member in a manual fashion. This is time-consuming and inefficient.

BRIEF DESCRIPTION OF THE DRAWINGS

The foregoing aspects and many of the attendant advantages of the claims will become more readily appreciated as the same become better understood by reference to the following detailed description, when taken in conjunction with the accompanying drawings, wherein:

DETAILED DESCRIPTION

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

The subject matter disclosed herein is related to a self-releasing cable lift system. In one embodiment, the system may include a latch coupled to a winch and operable to lift an object, such as a gangway, into a secured position before self-releasing after the object is locked into place. Such a latch may be biased to an open position when setting free, but biased to a closed position when acted upon by an outside surface. Thus, the latch includes a first biasing surface that is operable to bias the latch to the closed position when the latch is moved into contact with a latch receptacle in a first direction. Further, the latch includes a second biasing surface that is operable the bias the latch to a closed position when it is moved into contact with a sleeve, in a second direction. In this manner, the latch may engage a gangway, when lowered, but then self-release when the gangway has been raised.

Figure 1:
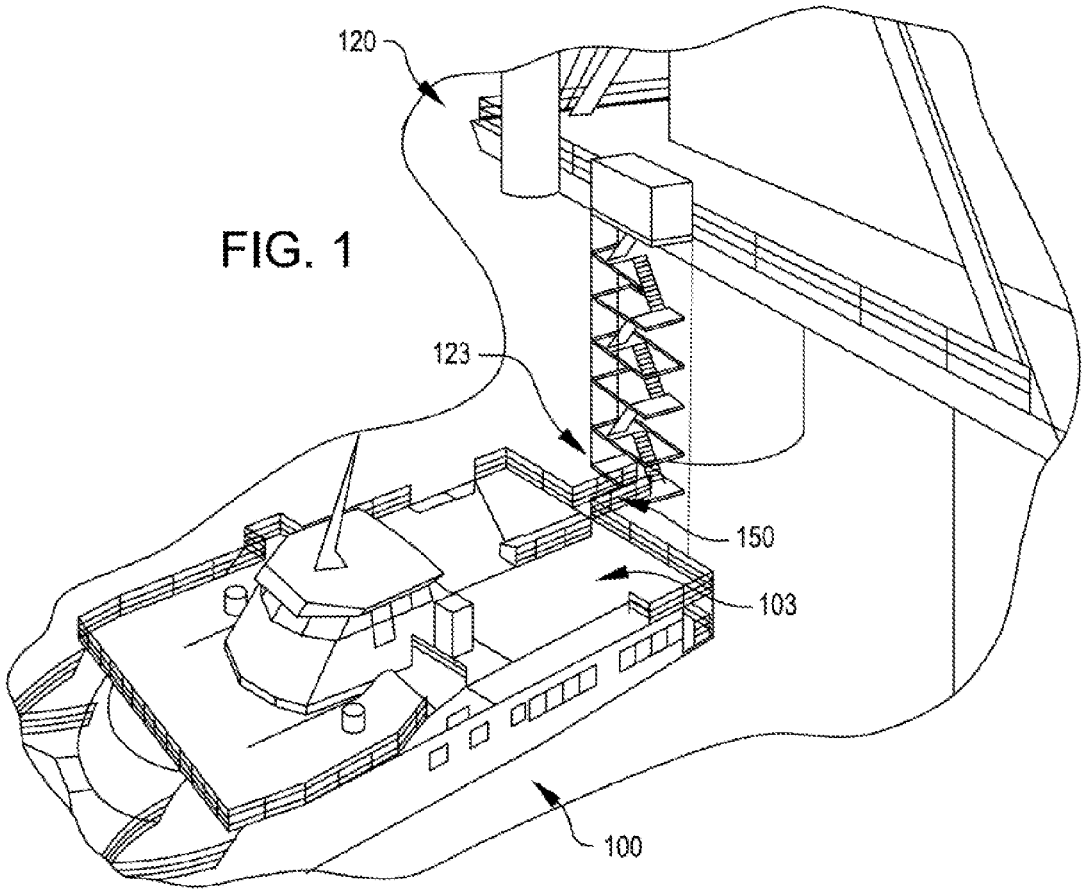
FIG. 1 shows an embodiment of a system including a vessel positioned next to a nearby platform.

FIG. 1 shows an embodiment of a system including a vessel 100 positioned next to a nearby platform 120. The vessel 100 may be anchored near the platform 120 for the purposes of loading or offloading crew and cargo to and from the platform 120. Thus, a gangway 150 may extend from the vessel 100 to the platform 120. Such a vessel 100 may be a cargo ship or personnel transport and the platform 120 may be an oil derrick or off-shore drilling facility. A skilled artisan will understand that the embodiments discussed herein may equally be applied to any vessel and any stationary platform on the ocean or other body of water.

In FIG. 1, one can see that the top deck 103 of the vessel 100 is below the lowest deck 123 of the platform 120. As such, the gangway 150 may be used to provide a coupling between the vessel 100 and the platform 120. Such a gangway 150 may be permanently fixed at one end to the top deck 103 of the vessel 100 and then maneuvered or lifted into position when needed for vessel ingress and egress. When in position, the other end of the gangway 150 may be removably attached to the lowest deck 123 of the platform 120. In other embodiments not depicted in FIG. 1, the top deck 103 of the vessel 100 may be above the deck of the platform 120 to be engaged. Thus, the gangway 150 may engage with different decks of the platform 120. In still further embodiments, the gangway 150 may be permanently fixed to the platform 120 and removably attached to the vessel 100 when in use. Various aspects of such a gangway 150 are described in greater detail in related U.S. patent application Ser. No. 12/552,175 entitled CLOSED-LOOP CONTROL SYSTEM FOR CONTROLLING A DEVICE assigned to the same assignee of the present disclosure and is hereby incorporated by reference.

The gangway 150 may include an associated control mechanism (not shown in detail in FIG. 1) wherein an operator may maneuver the gangway 150 into a deployed position (i.e., attached to the nearby platform 120 as is shown in FIG. 1) or into a stored position on the deck 103 of the vessel 100. The gangway 150 may be stored for when the vessel 100 is underway and not needed. As such, the stored position may include additional securing means to prevent the gangway 150 from moving about while the vessel 100 is underway. Such storage mechanisms are not shown in detail in any FIG. Aspects of the control mechanism are described below with respect to FIGS. 2 and 3.

Figure 2:
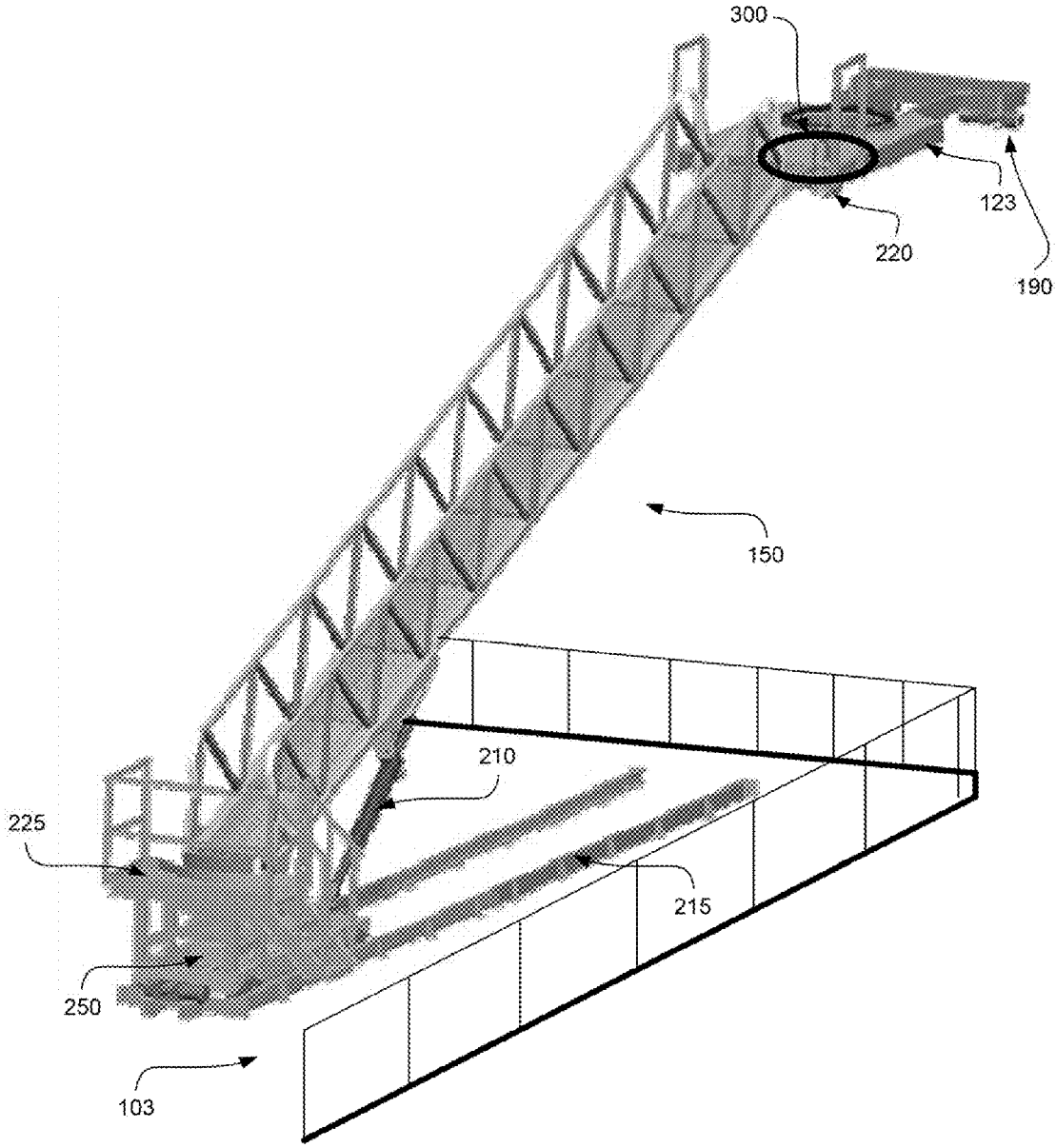
FIG. 2 shows an isometric view of an embodiment of a gangway that may be part of the system of FIG. 1.

FIG. 2 shows a more detailed isometric view of an embodiment of a gangway 150 that may be part of the system of FIG. 1. The gangway 150 may be permanently fixed to the top deck 103 of the vessel 100 (as described above) at a first end 225 of the gangway. Further, the other end, i.e., a second end 220 may be attached to a deck 123 of a nearby platform (FIG. 1). Thus, when the vessel requires crew and/or cargo to be loaded or off-loaded, the gangway 150 may be used for ingress of egress when coupled to the deck 123 of the platform (FIG. 1).

When a vessel 100 first arrives at the platform, the gangway 150 may be moved into position in a number of ways. In one embodiment, a winch 190 may lower cables (not shown in FIG. 2) to the second end 220 of the gangway 150 (hereinafter called the gangway head 220) which may be resting on the deck 103 of the vessel 100. Then, the winch 190 may lift the gangway head 220 up to the deck 123 of the platform and attach the gangway head 220 to the deck 123. As shown in FIG. 2, the gangway 150 has been lifted and secured into place with respect to the platform deck 123. A system 300 for interconnecting the lowered cables from the winch 190 and the gangway head 220 are detailed below in FIGS. 3A-3C.

Figure 3A:
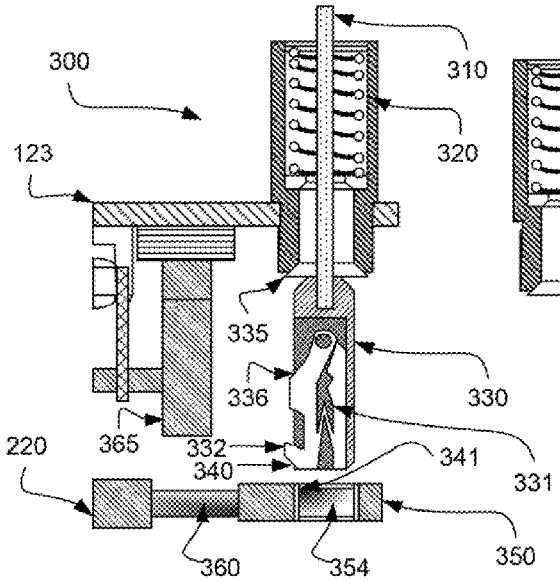
FIGS. 3A-3C show a self-releasing cable system that may be part of the system of FIG. 1.
Figure 3B:
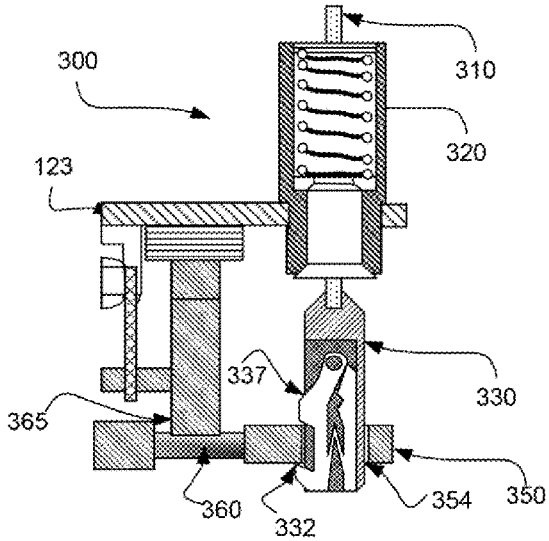
Figure 3C:
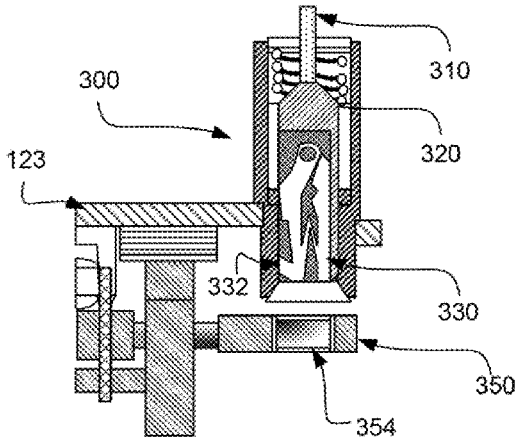

In other embodiments, a control system 250 may control one or more hydraulics lifts 210 to maneuver the gangway 150 into place. Such a hydraulic control system 250 may include a number of hydraulic lifts 210 (all of which are not shown in detail) and may control the gangway 150 in several different directions, which are herein referred to as degrees of freedom. Such a hydraulic control system is discussed in greater detail in related U.S. patent application Ser. No. 12/552,175 entitled CLOSED-LOOP CONTROL SYSTEM FOR CONTROLLING A DEVICE assigned to the same assignee of the present disclosure and is hereby incorporated by reference. The remainder of this specification is related to a self-releasing cable lift system 300 as shown in FIGS. 3A-3C FIG. 3A shows a system 300 for interconnecting a device (such as the gangway head 220) with a platform deck 123 and the like. The system 300 provides a means for engaging a gangway head 220 when stored on the deck of a nearby vessel, then lifting the gangway head 220 to a secured position at a platform deck 123, and then self-releasing the cable attachments used to raise the gangway head 220. Further, when released, the gangway head may be secured to the platform deck using a securing mechanism and a locking device that ensures that the gangway head is attached to the platform deck 123 before the cable attachments are released. These and other aspects are described in greater detail in the following paragraphs.

The system 300 includes at least one cable 310 that is coupled at one end (not shown) to a winch 190 (FIG. 2) or hoist. Other embodiments not shown may include two or more cables and related cable components. The end of the cable 310 that is shown in FIG. 3A is coupled to a latch 330 that may be housed (when in a stored position) inside a sleeve 320 attached to the platform deck 123. The latch 330 may further include an interior member 331 that is designed to be biased to an open or closed position depending on differing forces acting upon it.

As shown in FIG. 3A, the latch 330 is uncoupled from the gangway head 220 and despite the close proximity as illustrated in FIG. 3A, this may represent a situation when the latch 330 is retracted near the platform deck 123 and a considerable distance is between the platform deck and the gangway head 220. Thus, this proximity is for illustrative purposes only.

In this initial state, the latch 330 is not yet engaged with the gangway head 220. Further, the platform deck 123 includes a securing mechanism 365 that is able to engage with a locking device 360 on the gangway head 220. As this is an initial state, the securing mechanism 365 is also not yet engaged with the locking device 360. Additionally, the interior member 331 is in an "open" position. That is, the natural state of the interior member is to have a first protrusion 332 and a second protrusion 336 extending outside the circumference of its housing. When the interior member 331 encounters and exterior force (e.g., comes into contact with a surface or the like, the interior member may contract into a "closed" position such that the first and second protrusions are pulled inside the circumference of the housing. As such, maneuvering the latch in specific directions to contact specific surfaces may cause the interior member 331 to close or allow it to open.

Looking closer at the latch 330, the interior member 331 is able to be biased to a closed position when moving in at least two directions. The interior member 331 may be biased to closed by the latch 330 coming into contact with one or more surfaces, namely a surface at the sleeve 320 or a surface at a latch receptacle 354 that is part of the gangway head 220. Based upon these surfaces biasing the interior member 331, the latch 330 may engage or disengage from the gangway head 220. These interactions between surfaces and the interior member 331 are shown and described in greater detail as the method for engaging and disengaging the gangway head 220 is detailed.

When an operator begins an engagement method, the cable 310 with the latch 330 attached thereto may be lowered toward the gangway head 220. When properly aligned, the latch 330 will begin to engage a latch receptacle 354. The first protrusion of the interior member 331 has a lower surface 340 that will make contact with a corner 341 of the latch receptacle 354. Because the lower surface 340 is angled, lowering the latch 330 (e.g., due to gravity or from an operator physically moving the latch 330) further will cause the interior member 331 to move toward a closed position. Once the interior member 331 close far enough, i.e., the first protrusion 332 is moved to within the circumference of the housing of the latch 330, then the entire latch 330 may slip through the latch receptacle 354. The latch 330 may then continue downward to further engage the gangway head 220 until fully engaged as shown in FIG. 3B.

FIG. 3B shows the latch 330 fully engaged with the gangway head 220. As the latch 330 is pushed through the latch receptacle 354, the first protrusion 332 of the interior member 331 eventually clears the bottom edge of the latch receptacle 354. When this happens, the interior member 331 expands back to an open position and the latch protrusion 332 prevents the latch 330 from being pulled back through the latch receptacle 354. As a result, the latch 330 and the gangway head 220 are now secured to each other and if the cable 310 is pulled up (e.g., the winch 190 (FIG. 2) begins to retract), then the entire gangway head 220 will be lifted toward the platform deck 123 because the latch protrusion 332 cannot retract as the interior member 331 is biased to its open position. That is, the interior member 331 will not close until it comes into contact with some other surface.

As the gangway head 220 approaches the platform deck 123, a locking device 360 on the gangway head 220 may be aligned with a securing mechanism 365 that is part of the platform deck 123. When the locking device 360 comes into contact with the securing mechanism, a secure engagement between the gangway head 220 and the platform 123 may be realized. Such an engagement is known in the industry and, as such, the securing mechanism 365 and the locking device 360 are not described in greater detail herein.

Once the gangway head is secured, the latch 330 may be released from the latch receptacle 354. The latch 330 is a self-releasing latch in that another protrusion 336 provides a means for closing the interior member 331 again when being moved in a second direction. The second direction in this embodiment is substantially opposite that of gravity as the winch 190 (FIG. 2) is lifting the gangway head 220 straight up. Thus, once can see that a top surface 337 of the second protrusion will eventually come into contact with a corner 322 of the sleeve 320. Again, because this top surface is angled, the interior member will be forced to a closed position again. Once closed far enough, the first protrusion 332 will clear the latch receptacle 354, thereby releasing the latch from the gangway head 220. Then, the method may move to a final secured position as shown in FIG. 3C.

FIG. 3C shows the latch 330 disengaged from the gangway head 220 after the locking device 360 has engaged with the securing mechanism 365 of the platform deck 123. The system 300 may be designed such that the spacing between the securing mechanism 365 and the sleeve are suited to not allow the sleeve 320 to force the interior member 331 closed until the locking device 360 is fully engaged with the securing mechanism 365. Further, a sensor 388 may be in place to sense that the gangway head is locked into place. In one embodiment, the hoisting is interrupted if the sensor 388 does not indicate that the gangway head 220 is locked in place. This prevents the latch 330 from disengaging before the securing mechanism 365 locks the gangway head 220 into place.

Once secured, the securing mechanism 365 then controls when the gangway head may be released as opposed to having latch with cable still attached. Such a release method may be a manual release initiated by deck personnel or may be automatic in response to an emergency button actuation. Without having to unlatch any lifting cables, the gangway head 220 may be immediately released if an emergency arises.

In one embodiment, the overall system (e.g., the platform 123, the winch 190 and the gangway 150) includes more than one self-releasing cable system 300. In the case of a gangway 150, a latch 330 and latch receptacle 354 may be present on a left and right side of the gangway head 220. In other embodiments, there may be only one system and the latch may secure to a latch receptacle that in evenly centered on the gangway head 220. In various embodiments, the winch or hoist may be electric, pneumatic, mechanical or hydraulic.

Figure 4:
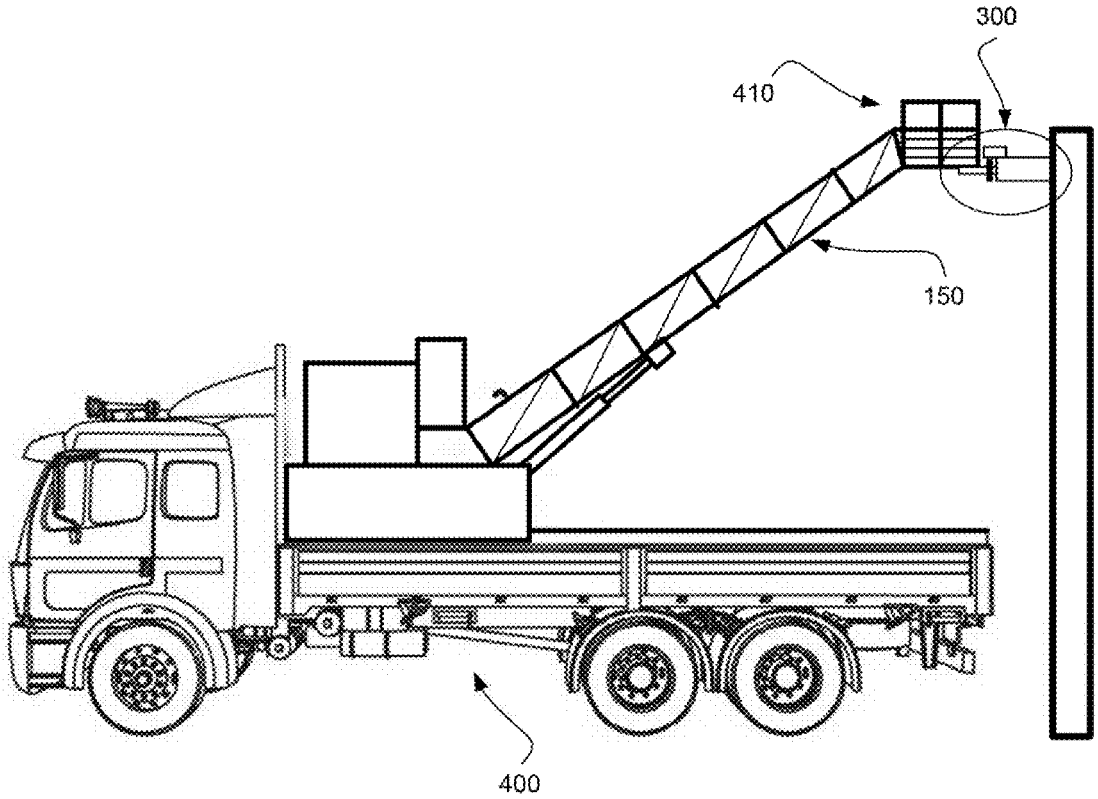
FIG. 4 shows an embodiment of a vehicle having a self-releasing cable system of FIG. 3 for securing a ladder system.

FIG. 4 shows another embodiment of the self-releasing cable system of FIG. 3A-3C wherein the system 300 is used on a ladder-truck 400 or man-lift. Such a self-releasing cable system 300 may be used to protect against power loss or hydraulic loss failures when a person may be in a basket 410 or at the top of a ladder. If hydraulics fail when a person is in place in the basket, the self-releasing cable system 300 may prevent problems that may arise from transferring the securing of the basket from the cable lift to any securing mechanism that may be present.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. An attachment device, comprising:
- a housing;
- a latch positioned inside the housing, the latch biased to an open position;
- a first biasing surface disposed on the latch and operable to bias the latch to a closed position when the attachment mechanism is moved into contact with an object in a first direction; and
- a second biasing surface disposed on the latch and operable the bias the latch to a closed position when the attachment mechanism is moved into contact with an object in a second direction.

2. The attachment device of claim 1 wherein the first direction comprises a direction approximately the same as a gravitational force and the second direction comprises a direction approximately opposite the gravitational force.

3. The attachment device of claim 1, further comprising an internal biasing member suited to bias the latch to an open position when not engaged with any external object.

4. The attachment device of claim 3 wherein the internal biasing member comprises a protrusion positioned to bias the latch to a closed position when the protrusion comes into contact with a latch receptacle.

5. The attachment device of claim 3 wherein the internal biasing member comprises a protrusion positioned to bias the latch to a closed position when the protrusion comes into contact with a latch sleeve.

6. A lifting system, comprising:
- a hoist;
- a cable having a first end and second end and attached to the hoist at the first end; and
- an attachment device, comprising:
  - a housing;
  - a latch positioned inside the housing, the latch biased to an open position;
  - a first biasing surface disposed on the latch and operable to bias the latch to a closed position when the attachment mechanism is moved by the hoist into contact with an object in a first direction; and
  - a second biasing surface disposed on the latch and operable the bias the latch to a closed position when the attachment mechanism is moved by the hoist into contact with an object in a second direction.

7. The lifting system of claim 6 wherein the hoist comprises a winch having power provides by means of one of the group including, mechanical, electrical, pneumatic and hydraulic.

8. The lifting system of claim 5, further comprising a securing mechanism for securing a lifted object into a locked position.

9. The lifting system of claim 8 wherein the lifted object comprises a gangway suitable for ingress and egress on a vessel.

10. A platform, comprising:
- a platform deck;
- at least one winch disposed on the platform deck;
- a cable having a first end and second end and attached to the hoist at the first end; and
- an attachment device, comprising:
  - a housing;
  - a latch positioned inside the housing, the latch biased to an open position;
  - a first biasing surface disposed on the latch and operable to bias the latch to a closed position when the attachment mechanism is moved by the winch into contact with an object in a first direction; and
  - a second biasing surface disposed on the latch and operable the bias the latch to a closed position when the attachment mechanism is moved by the winch into contact with an object in a second direction.

11. The platform of claim 10, further comprising an ocean-based oil platform suited to interface with ocean-based vessels via a gangway between the platform and the vessel.

12. The platform of claim 11, further comprising a first winch for operating a first cable having a first latch suited to engage a first side of a gangway head and a second winch for operating second cable having a second latch suited to engage s second side of the gangway head.

13. The platform of claim 11, further comprising a securing mechanism disposed on the platform operable to engage a locking device disposed on the gangway.

14. The platform of claim 13, further comprising an emergency release actuator operable to release securing mechanism when actuated.

15. The platform of claim 13, further comprising a sensor operable to determine if the securing mechanism is engaged with the locking device and operable to interrupt the winch if the sensor determines that the securing mechanism is not engaged with the locking device when the second biasing surface contacts the object in the second direction.

* * * * *